US005455113A

United States Patent [19]

Girgis et al.

[11] Patent Number: 5,455,113

[45] Date of Patent: * Oct. 3, 1995

[54] IMPREGNATED FIBER BUNDLES HAVING INDEPENDENTLY CROSSLINKABLE POLYURETHANE

[75] Inventors: Mikhail M. Girgis; Peter C. Gaa, both of Wexford; Balbhadra Das, Allison Park, all of Pa.

[73] Assignee: PPG Industries, Inc., Pittsburgh, Pa.

[ * ] Notice: The portion of the term of this patent subsequent to May 24, 2005 has been disclaimed.

[21] Appl. No.: 114,587

[22] Filed: Aug. 31, 1993

Related U.S. Application Data

[63] Continuation of Ser. No. 741,708, Aug. 7, 1991, abandoned.

[51] Int. Cl.[6] ..... B32B 5/00

[52] U.S. Cl. ..... 428/357; 428/361; 428/375; 428/378; 428/391; 428/392; 428/394; 428/395; 524/589; 525/112

[58] Field of Search ..... 428/378, 375, 428/391, 392, 394, 395, 357, 361; 524/589; 525/112

[56] References Cited

U.S. PATENT DOCUMENTS

| | | | |
|---|---|---|---|
| 2,955,095 | 10/1960 | Gollob | 260/30.8 |
| 3,248,371 | 4/1966 | Damnsis | 260/77.5 |
| 3,415,768 | 12/1968 | Dieterich et al. | 260/29.2 |
| 3,485,778 | 12/1969 | Oertel et al. | 260/18 |
| 3,531,425 | 9/1970 | Burk et al. | 260/21 |
| 3,563,943 | 2/1971 | Davis et al. | 260/29.2 |
| 3,583,943 | 6/1971 | Weber et al. | 260/75 |
| 3,621,000 | 11/1971 | Schmeizer et al. | 260/77.5 AM |
| 3,652,507 | 3/2872 | Burk, Jr. et al. | 260/77.5 AB |
| 3,694,389 | 9/1972 | Levy | 260/23 TN |
| 3,702,320 | 11/1972 | Fritck et al. | 260/77.5 |
| 3,829,122 | 8/1974 | Bastide | 280/150 B |
| 3,833,525 | 9/1974 | Orlando et al. | 260/2.5 AC |
| 3,846,378 | 11/1974 | Griswold | 260/77.5 |
| 3,926,875 | 12/1975 | Tsugukuni et al. | 260/23 TN |
| 3,929,744 | 12/1975 | Wright et al. | 260/80.73 |
| 3,993,849 | 11/1976 | Victorius | 428/463 |
| 4,046,744 | 9/1977 | Jenkins | 260/77.5 |
| 4,049,077 | 9/1977 | Russell et al. | 132/7 |
| 4,066,591 | 1/1978 | Scriven et al. | 260/29.2 TN |
| 4,137,209 | 1/1979 | Wong et al. | 260/29.6 NR |
| 4,238,378 | 12/1980 | Markusch et al. | 260/29.2 TN |
| 4,255,317 | 3/1981 | Coakley et al. | 260/37 N |
| 4,271,229 | 6/1981 | Temple | 428/288 |
| 4,289,672 | 9/1981 | Friederich et al. | 428/378 |
| 4,291,632 | 9/1981 | Barty | 108/51.1 |
| 4,301,257 | 11/1981 | Zengel et al. | 525/329 |
| 4,335,029 | 6/1982 | Dabi et al. | 524/589 |
| 4,338,234 | 7/1982 | Moore et al. | 523/206 |
| 4,382,991 | 5/1983 | Pollman | 428/391 |
| 4,663,231 | 5/1987 | Girgis et al. | 428/378 |
| 4,749,743 | 6/1988 | Ambrose et al. | 525/123 |
| 4,762,750 | 8/1988 | Girgis et al. | 428/378 |
| 4,762,751 | 8/1988 | Girgis et al. | 428/378 |
| 5,130,198 | 7/1992 | Swisher et al. | 428/391 |
| 5,182,784 | 1/1993 | Hager et al. | 385/128 |
| 5,247,004 | 9/1993 | Swisher et al. | 524/494 |

FOREIGN PATENT DOCUMENTS 2300368 1/1973 Fed. Rep. of Germany

OTHER PUBLICATIONS

"Isocyanates, Organic", *Encyclopedia of Chemical Technology*, John Wiley & Sons, New York, 1981, vol. 13, pp. 799–807.

"Polymeric–Containing Compositions with Improved Oxidative Stability", Robert G. Swisher et al., U.S. Ser. No. 07/912,448, filed Jul. 13, 1992.

*Primary Examiner*—Patrick J. Ryan
*Assistant Examiner*—Richard Weisberger
*Attorney, Agent, or Firm*—Kenneth J. Stachel

[57] ABSTRACT

Flexible coated bundles of fibers are provided that are both encapsulated and impregnated with a coating of one or more independently partially crosslinkable polyurethane. The fibers in the bundle can have a first chemical treatment or size and the bundle of these fibers is treated to have the coating of the polyurethane. The coating impregnates the bundle so that a majority of the fibers have a substantial portion of their surfaces covered with the coating. The independently partially crosslinkable polyurethane is selected from polyurethane polymers that are solvent-soluble, dispersible or emulsifiable that produce a thermoplastic elastomeric film. The partial crosslinkability is from one or more of the following types of crosslinking: self-crosslinkable, internally crosslinkable and/or in-situ crosslinkable. Additional components other than external crosslinking agents can also be present in the coating composition.

30 Claims, 2 Drawing Sheets

IMPREGNATED FIBER BUNDLES HAVING INDEPENDENTLY CROSSLINKABLE POLYURETHANE

This application is a continuation of application Ser. No. 07/741,708, filed Aug. 7, 1991, now abandoned.

The present invention is directed to chemically treated bundles of fibers such as strands and yarns which have a coating that both encapsulates the bundle and but impregnates the bundle with the chemical treatment. This provides flexible coated bundles that can have high tensile strength, good weatherability, good chemical resistance and good hydrolytic stability.

Coated and impregnated chemically treated fiber bundle products were disclosed in U.S. Pat. Nos. 4,663,231; 4,762,750; and 4,762,751. This product has fibers that are chemically treated with a size and gathered into bundles and coated with an aqueous coating composition. The aqueous coating composition both encapsulates and impregnates the fiber bundles. The sizing composition can be comprised of at least a fiber protectorant and the coating composition is in one instance a polyurethane, in another instance a nonchlorinated, nondiene-containing polymeric material and in the third instance an elastomeric ethylene-containing interpolymer. These polymeric materials are those that are water-emulsifiable, dispersible or soluble and in conjunction with these polymeric materials, there is a crosslinking agent to produce a degree of crosslinking that is effective to reduce any tackiness of the elastomeric polymer, to render the elastomeric polymer water insoluble in the moisture reduced impregnant polymer, or to provide a certain hardness and modulus of the film of the moisture reduced residue. In addition, other components can be present in the coating composition. This coated bundle has good flexural strength and tensile strength and good hydrolytic stability.

It is an object of the present invention to provide coated fibrous bundles with good mechanical properties utilizing a simplified coating formulation.

SUMMARY OF THE INVENTION

The aforementioned and other objects eclectically gleaned from the following disclosure are accomplished by the coated fibrous bundles of the present invention.

The coated fibrous bundles have a plurality of chemically treated or sized fibers wherein the plurality of sized fibers are coated with a residue that is a moisture-reduced residue of an aqueous coating composition or a solvent evaporated residue of an organic solvent-based polyurethane coating composition. The coated bundles are encapsulated and impregnated by the residue so that the term "coating" encompasses both the encapsulation and the impregnation. The degree of impregnation is to the extent that a majority of the fibers in the bundle have a substantial portion of their surfaces containing the residue.

The coating composition has one or more independently partially crosslinkable polyurethane polymers that are carrier-soluble, dispersible or emulsifiable that produce a thermoplastic elastomeric film. The types of independently crosslinkable polyurethanes are one or more of the following types of crosslinking: self-crosslinkable, internally crosslinkable and/or in-situ crosslinkable, all of which are partially crosslinkable without the presence of separate and distinct external type of crosslinking agents in the coating composition.

The at least one partially crosslinkable polyurethane provides a film of the coating composition that principally is formed through the reduction of the carrier, whether an organic solvent or water, either on air drying or on drying at elevated temperatures after application to the bundle of fibers. Evaporation of the carrier and/or phase of an emulsion or dispersion of the polyurethane produces coalescence since the polyurethane chains do not remain apart so that the viscosity increases and droplets coalesce and electrostatic and Van der Waal's forces and possibly some covalent linkages form a substantial portion of the film.

The independently crosslinkable polyurethane is one that can give a degree of crosslinking in the range up to that which provides a polyurethane film modulus equivalent to that of up to around 8000 psi at 100 percent elongation. This polyurethane is one that can also give a partially crosslinked polyurethane film having an ultimate elongation in the range of around 50 to 1400 percent. When the modulus of the polyurethane film is less than around 250 psi at 100 percent elongation, a debinding agent is included in the coating composition. So these independently crosslinkable polyurethanes provide a partial or slight degree of crosslinking so that the coating of the bundles of fibers or strands do not loose the thermoplasticity of the film or coating.

The independently crosslinkable polyurethanes used in the coating composition of the present invention include by the use of the term "polyurethane" the polyurethane-polyureas containing urea groups. The self-crosslinkable polyurethanes include: 1) polyurethane polymers with difunctional repeating units present from polymerization of the polyurethane with some tri, tetra and/or penta functional monomer; 2) polyurethanes with a high concentration of urea in the backbone produced from condensation of the polyurethane with diamine compounds; 3) polyurethanes with pendent moieties including amine, carboxylic acid groups, epoxy groups, ureas, and the like; 4) polyurethanes with ethylenic unsaturation in the backbone from the presence of monoethylenically unsaturated polyfunctional monomers such as unsaturated polyesters and polyethers in the polymerization of the polyurethane; and 5) blocked, capped, or masked polyurethanes. The internally crosslinkable polyurethanes include thermally rearranged polyurethanes. Examples are polyurethanes with pendent amine groups which can react through a condensation or an addition reaction which upon heating undergo rearrangement crosslinking for instance through formation of biuret and allophanate groups, and polyurethanes like Witco 290H material. In-situ crosslinkable polyurethanes are those that can crosslink with a chemical moiety or functionality on the fibers or in the sizing on the fibers.

In addition to the independently crosslinkable polyurethane, the aqueous coating composition can have an amount of wax, especially when the polyurethane has a low modulus, and plasticizer and the polyurethane is at least one polyurethane or could be a blend of polyurethanes.

Bundles of fibers that are coated with the independently partially crosslinked polyurethane have at least a two fold increase in flexibility over uncoated fiber bundles of similar construction. Such an increase can be from 100 cycles on an MIT flexural tester to within the range of 200 to 8000 for a bundle of around 1000 sized fibers having a filament diameter of around 5.25 plus or minus $0.25\times10^{-4}$ inch.

The sized glass fibers are those having a dried residue of an aqueous chemical treating composition having one or more components where at least one component is a fiber protectorant. This material protects the fibers from interfilament abrasion in the bundle. The carrier-containing composition is applied to the bundle of fibers or strands by dipping, or spraying or any other method of coating.

DETAILED DESCRIPTION OF THE INVENTION

Figure 1:
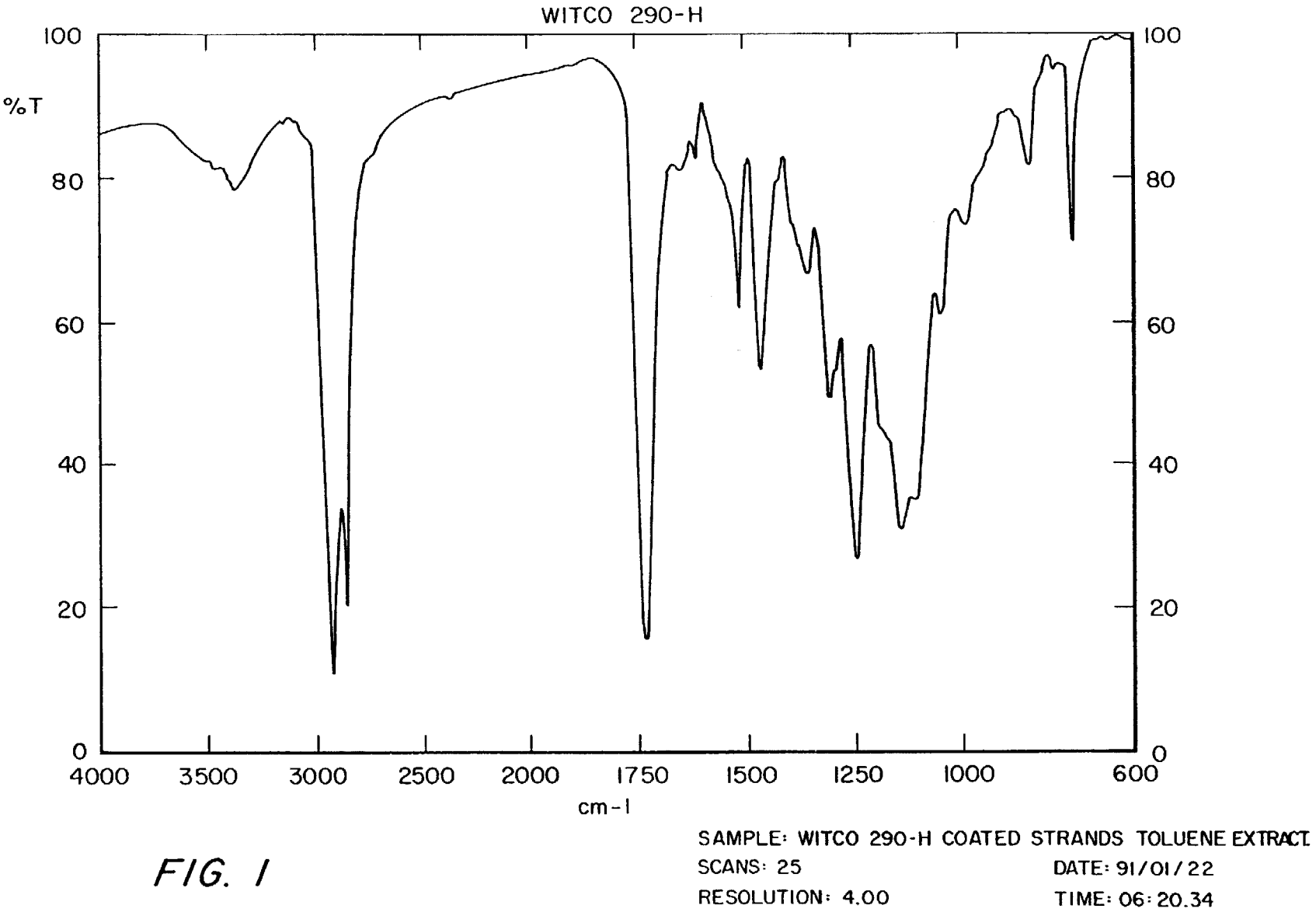
FIG. 1 is an Fourier Transform Infrared (FTIR) spectrograph of the residue obtained from extracting the coated bundle with boiling toluene for two hours where the bundles were coated with a Witcobond 290H polyurethane.

We have discovered that the flexible coated bundle of fibers can in certain situations have similar properties of flexibility and strength to the coated bundles of U.S. Pat. Nos. 4,762,750 and 4,762,751 without the use of external crosslinking agents in the carrier-containing composition. The crosslinking agents need not be used when certain types of polyurethanes are used to comprise the carrier-containing coating composition and these polyurethanes are the independently crosslinkable polyurethanes.

Generally, the independently crosslinkable polyurethanes can be produced by art recognized methods for producing traditional polyurethanes and is elaborated further in the following description. The reaction usually involves the reaction of a polyfunctional active hydrogen compound like polyol, polyether polyol, hydroxyl-terminated polyester, acrylic polyol, polyester amide, and the like with a diisocyanate or other polyisocyanate. The reaction can involve the use of an excess of the polyisocyanate. The work by J. H. Saunders and K. C. Frisch, entitled, "Polyurethanes: Chemistry and Technology", Part II, from Interscience (New York 1964), especially on pages 8 through 49, and in the various references cited therein provides an extensive description of some of the useful techniques for preparing polyurethanes.

Nonexclusive examples of polyols that can be useful in preparing the isocyanate-terminated polyurethane compound are diols, triols, and combinations thereof. Such polyols include those disclosed in U.S. Pat. Nos. 3,248,371; 3,583,943; 3,846,378; and 4,046,744. The work entitled, "The Development and Use of Polyurethane Products" by E. N. Doyle and from McGraw-Hill, 1971 teaches other useful polyols. Suitable polyols include hydroxy-terminated linear polyols prepared from oxiranes and lactones. These suitable polyols are exemplified by polyoxyethylene diols, polyoxypropylene diols and 2-oxepanone polymers of 2,2'-oxybisethanol known as polycaprolactone diols.

Suitable polyisocyanates are those commonly employed in polyurethane synthesis, such as aliphatic and cycloaliphatic diisocyanates like hexamethylene diisocyanate, trimethylhexamethylene diisocyanate, isophorone diisocyanate, 4,4'-methylenedicyclohexyl diisocyanate, and other polyisocyanates of this type; aromatic diisocyanates such as toluene diisocyanates and 4,4'-methylenediphenyl diisocyanate; and higher polyisocyanates such as a triisocyanate, for example, the biuret of 1,6-hexamethylene diisocyanate, commercially available as Desmodur® material from Mobay Chemical Company. Other polyisocyanates which are useful for forming the isocyanate-terminated polymer are disclosed in numerous U.S. Patents including U.S. Pat. Nos. 3,621,000; 3,694,389; 3,846,378; 3,926,875; 3,993,849; and 4,046,744. Still other useful polyisocyanates are taught by Doyle in "The Development and Use of Polyurethane Products", supra.

It has been recognized that in order to produce cured polyurethane films which have a reduced tendency to yellow it is more suitable to use linear diols and aliphatic diisocyanates to prepare the independently crosslinkable polyurethane polymer. An example of such a suitable linear diol is polycaprolactone having a formula weight of between about 500 and 2,000, preferably between 500 and 1,000. The linear aliphatic diisocyanates that can be used include: cyclohexane-1,4-diisocyanate, 4,4'-methylenedicyclohexyl diisocyanate, isophorone diisocyanate, hexamethylene-1,6-diisocyanate, trimethyl hexamethylene diisocyanate, methyl cyclohexyl diisocyanate, and tetramethylene-1,4-diisocyanate. Particularly suitable aliphatic diisocyanates are 4,4'-methylene-dicyclohexyl diisocyanate and 4,4'-Methylenedicyclohexyl diisocyanate.

The equivalent ratio of polyisocyanate to polyol may vary between a slight excess of polyisocyanate to a large excess of polyisocyanate, i.e. from an equivalent ratio of about 1.01:1.00 NCO/OH to an equivalent ratio of about 4.00:1.00 NCO/OH. A suitable equivalent ratio can be NCO/OH of 2:1.

In preparing the polyurethane, the typical urethane synthesis catalysts can be used. These include those disclosed by Doyle in "The Development and Use of Polyurethane Products", supra. For example, catalysts can be used that promote to a limited extent or don't promote trimerization of the diisocyanate depending on the manner in which the polyurethane is independently crosslinkable. The latter type include tin, zinc, manganese, cobalt, and zirconium compounds. Tertiary amines may also be used and some do while others do not promote trimerization of the isocyanate, and metal catalysts of tin and zinc are useful with a combination of zinc 2-ethylhexoate and dibutyl tin dilaurate.

It is also possible to use an aprotic solvent or a solvent which is inert to the reaction, such as benzene, toluene, xylene or similar unreactive hydrocarbons. The solvent can be present in the reaction mixture in a concentration of up to about 50 parts by weight of solids. The solvent should be sufficiently low boiling so that it will vaporize at ambient or slightly elevated temperatures when coated on the bundle of fibers. Typical solvents are heterocyclic, aliphatic or aromatic hydrocarbons, monohydric or polyhydric alcohols, ethers, esters and ketones, such as, for example, N-methylpyrrolidone, butanol, ethylglycol and butylglycol butyldiglycol, ethylene glycol dibutyl ether, ethylene glycol diethyl ether, diethylene glycol dimethyl ether, cyclohexanone, methyl ethyl ketone, acetone, isophorone 2-butoxyethyl acetate, toluene, xylene, 2-ethoxyethyl acetate, 2-(2-ethoxy)ethoxethyl acetate, ethyl acetate, butyl acetate, amyl acetate, other similar esters, ketones, chlorinated solvents, nitro-aliphatic solvents, dioxane, and the like, or mixtures thereof.

The aforementioned solvents can also serve as the organic solvent carrier for the coating composition but the preferred carrier is water while some of the aforementioned organic solvents may be present in the polyurethane emulsions or dispersions that are diluted with the water carrier.

The aforementioned monomers and catalysts can be useful in producing all of the independently crosslinkable polyurethanes used in the present invention. When the polyurethane is the kind having some trifunctional moieties, the trifunctional monomer is used with any of the aforementioned monomers and catalysts, if any. Nonexclusive examples of trifunctional monomer that may be incorporated into the polyurethane include: trimethylolpropane, dimethylolpropionic acid and tri, tetra or penta functional isocyanate or polyol monomers. The trifunctional material is used in an effective mole percent to produce the independently crosslinkable polyurethane for partial crosslinking. The polyureaurethanes with the urea in the backbone or pendant from the backbone can be used where the amount of urea in the polymer is effective in producing the polyurethane with the slight or partial crosslinkability. The polyurethanes with pendent moieties has an effective amount of these moieties or reactive monomers to provide the partial crosslinkability of the polyurethane. Additionally, these groups may provide for water emulsifiability or dispersibility. The term "reactive monomers" denotes a monoethylenically unsaturated monomer which includes a group other than the ethylenic group which is reactive under the conditions of cure with the reactive group present in the self-crosslinking polyurethane. These groups are illustrated by the carboxyl group (which may be supplied by acrylic or methacrylic acid), the hydroxyl group (which may be supplied by hydroxyethyl rheology. The preparation of both of these types of polyurethanes is well known in the art.

Suitable examples of epoxy-functional polyurethanes are those given in U.S. Pat. No. 4,749,743, hereby incorporated by reference, where the amount of the epoxy moieties present is at a minimum amount to give only a partial crosslinking to maintain the thermoplasticity of the film of the coating composition on the bundles of fibers. Also, U.S. Pat. No. 4,829,122 is an example of polyurethane-polyureas containing one blocked group which releases a free primary or secondary amine group to assist in crosslinking. Again, the amount of the moiety leading to the release of the free primary or secondary amino group is limited to obtain only partial crosslinking.

The polyurethanes with the unsaturation can be prepared with isocyanate-functional free-radical addition monomer, like isocyanate-functional acrylics and isocyanate-functional styrenes, utilized as the polymeric starting compound. The preparation of isocyanate-functional acrylics is well-known in the art and is described in U.S. Pat. Nos. 3,929,744; 4,291,632; and 4,301,257, all of which are incorporated herein by reference. Furthermore, polymers which can, by known reaction techniques, be converted to isocyanate-functional polymers are also usefully employed as the polymeric starting compound. For example, amine-functional polymers can be converted into isocyanate-functional polymers by the methods described in *The Encyclopedia of Chemical Technology*, John Wiley and Sons, New York, N.Y. (1981), Vol. 13, at pages 799 through 807, incorporated herein by reference.

Suitable blocked, capped or masked polyurethanes are the condensation polymeric products of an organic diisocyanate such as the aforementioned diisocyanates like toluene diisocyanate with the aforementioned monomers like an organic polyol such as polypropylene glycol reacted to a low molecular weight using an excess of polyisocyanate to form an isocyanate terminated prepolymer. The prepolymer is reacted with heat labile or blocking agents which contain an active hydrogen atom, such as a phenol, an aliphatic or aromatic amine, etc. The crosslinkable, terminally blocked polymers are generally of low molecular weight, and contain very few terminally blocked isocyanate groups, thereby limiting their potential for crosslinking. The polyurethane is stable at ambient temperature but reacts at elevated temperatures of generally around 150° C. to around 200° C. to regenerate the free isocyanate group, which can react further with, e.g., the prepolymer or a polymer containing active hydrogen atoms to form the polymer. U.S. Pat. No. 3,833,525 teaches a one-package polyurethane system consisting of blocked diisocyanate, a polyol and a nitrogen-containing heterocyclic compound, in which system the isocyanate groups are liberated at a temperature as low as 70° C.

Another nonexclusive example of a polyurethane made with blocked isocyanate diol is one that comprises an organic diisocyanate containing a blocked isocyanate group and an isocyanate group which has been reacted with the amine portion of an amine diol of one of the general formulae:

$$NH(QOH)_2 \text{ or } NHRQ'(OH)_2$$

wherein Q can be an alkylene with 2 to 20 carbons or aralkylene with 7 to 20 carbon radical in which the hydroxyl group can be attached to an aliphatic carbon atom, and Q' can be an alkylene with 2 to 20 carbons or aralkylene with an 8 to 20 carbon atom radical in which each of the hydroxyl groups can be attached to a different aliphatic carbon atom, and R can be hydrogen or an unsubstituted or substituted alkyl, alkenyl cycloalkenyl, cycloalkylene, aryl, alkaryl, or aralkyl radical which is not reactive with active hydrogen atoms or isocyanate groups. These types of blocked isocyanate diols may be copolymerized to form stable polyurethane compositions which are crosslinkable with heat, and the thermoplastic polyurethanes of high molecular weight can be made into films before being crosslinked.

Another nonexclusive example of useful blocked polyurethanes are those prepared as copolymerizable blocked isocyanate diols from reaction of a blocking agent with an isocyanate group of an organic isocyanate under controlled conditions, thereby forming a blocked isocyanate group, and reacting the second isocyanate group in a subsequent step with the amine portion of a selected amine diol under anhydrous conditions. In this reaction sequence when any of the monomers is comprised of an isomeric mixture, e.g., a mixture of 2,4- and 2,6-toluene diisocyanate, the final product will likewise be comprised of an isomeric mixture. Similarly, monomers of nearly equal reactivity will result in a mixture of products, with the desired product being isolated from the mixture by suitable techniques. Nonexclusive examples of the amine diol include: diethanolamine, diisopropanolamine, 2-amino-2-methyl-1,3-propanediol, and 2-amino-2-ethyl-1,3-propanediol. Nonexclusive examples of the blocking agents include: methyl ethyl ketoxime, t-butyl alcohol or phenol. In lieu of the amine diols, other types of chain extenders can be used such as diamines like ethylene diamine, diethylene triamine, propylene diamine, butylene diamine, hexamethylene diamine, toluene diamine, and the like. These materials can be used with most any of the aforementioned organic diisocyanates. The resultant products are used to prepare self-crosslinkable, linear polyurethanes of high molecular weight.

The blocking agents that can be used in the aforementioned reactions are compounds which contain an active hydrogen atom reactive with the isocyanate group and which will at moderate temperatures (up to 200° C.) cleave from the blocked adduct, liberating free isocyanate. The reactive hydrogen atoms are commonly attached to oxygen (e.g., hydroxyl groups), sulfur, or nitrogen atoms, however; they may also be attached to carbon atoms which are highly activated by other groups in close proximity therewith. Suitable blocking agents include, for example, the phenol type, lactam type, active methylene type, alcohol type, mercaptan type, acid amide type, imide type, amine type, heterocyclic amine-containing type like the imidazole type, urea type, carbonate type, imine type, oxime type and sulfite type. Phenol-type blocking agents can include: phenol, cresol, xylenol, hydroxybenzoic acid, hydroxybenzoic acid esters, and alkylphenols. Lactam-type blocking agents can include: epsilon-caprolactam, delta-valerolactam, gamma-butyrolactam, beta-propiolactam, and the like. Active methylene type blocking agents include: alkylmalonate and alkylacetoacetate for instance diethyl malonate, methyl acetoacetate, and the like. Alcohol-type blocking agents include: include the lower alkyl alcohols like methanol, up to t-butyl alcohol, and amyl alcohols, lauryl alcohol, alkylene glycols ethers like ethylene glycol monomethyl ether and diethylene glycol monomethyl ether, diethylene glycol monoethyl ether, propylene glycol monomethyl ether, methoxymethanol, methylol urea, methylol melamine, glycolic acid, glycolic acid esters, lactic acid, lactic acid esters, diacetone alcohol, ethylene chlorohydrin, ethylene bromohydrin, 1,3-dichloro-2-propanol, omega-hydroperfluoro-alcohol, acetocyanohydrin, and the like.

Also suitable are the blocking agents of the following types: mercaptan, acid amide, imide, amine, imidazole, urea, carbamate, imine, oxime, and sulfite. Nonexclusive examples of these types include: butylmercaptan, t-dodecylmercaptan, 2-mercapto-benzothtazole, and thiophenols; 2) acetoanilide, acetoanilide, acetotoluide, acrylamide, methacrylamide, acetamide, stearylamide, benzamide; 3) succinimide, phthalimide; 4) diphenylamine, xylidine, N-phenylxylidine, arbazole, aniline, naphthyl amine, and butyl amine; 5) imidazole, 2-ethyltmidazole; 6) urea, thiourea, ethylene urea and thiourea; 7) N-phenylcarbamate, 2-oxazolidone; 8) ethyleneimine; 9) formaldoxime, acetaldoxime, acetoxime, methylethylketoxime, diacetyl monoxime, benzophenone oxime, cyclohexanone oxime, methyl ethyl ketoxime; and 10) alkali metal bisulfites.

Another example of blocked polyurethanes include: the isocyanate-terminated prepolymer can be the reaction product of an organic compound containing two isocyanate-reactive hydrogen atoms, melamine, and a dihydroxyalkanoic acid, with a stoichiometric excess of organic diisocyanate. The prepolymer reaction is carried out in organic solvent which is preferably N-methyl pyrrolidone. This solvent remains in the final aqueous dispersion which typically contains about 13 percent N-methyl pyrrolidone. The final polyurethane desirably contains about 1% to about 5% by weight of units derived from melamine. Melamine may be included with the polyol for reaction with excess diisocyanate, it can be replaced with other polyamines, like benzoguanamine or groups, amine such as triethyl amine.

As an alternative to employing well-known blocking agents to block the isocyanate functionality of the polymer, polymeric materials may be utilized which inherently contain masked isocyanate functionalities, which can be unmasked by heating. For example, cyclic nitrile adducts containing two or more cyclic nitrile-functional groups enter into a ring-opening addition reaction in the presence of heat and crosslinking agents to result in cured polymers containing urethane and/or urea linkages. The preparation of cyclic nitrile adducts is described in U.S. Pat. Nos. 3,531,425; 3,652,507; 3,702,320; and 4,049,007, all of which are incorporated herein by reference.

Additional examples of the blocked polyurethanes are disclosed in U.S. Pat. No. 4,066,591 (Scriven, et al.) hereby incorporated by reference herein. A suitable non-exclusive example of a solvent-based blocked polyurethane is U-7015-Neorez available from ICI Americas Inc. A non-exclusive example of an aqueous dispersion of a blocked polyurethane is the Nopcothane D-641 and D-610 products available from Henkle Chemical Corp.

The copolymerizable blocked isocyanate diols may be readily prepared according to the following representative reaction sequence using methyl ethyl ketoxime as the blocking agent, toluene diisocyanate as the organic diisocyanate, and diethanolamine as the amine diol.

A process for preparing such a blocked isocyanate diol as the aforementioned one comprises the steps of: a) reacting a blocking agent like one that contains a hydroxyl group with an organic diisocyanate at a temperature of 25° C. to 100° C. for 1 to 8 hours for aromatic diisocyanates and at 50° C. to 120° C. for 3 to 10 hours for aliphatic diisocyanates, wherein the ratio of blocking agent to diisocyanate is from around 0.8 to around 1.0 to around 1:1. Generally, the equivalent ratio of blocking agent to isocyanate equivalent present in the isocyanate-functional prepolymer along with the time and temperature of the reaction and deblocking reaction depends on the number and the size of the repeating units in the prepolymer. Increases in the ratio, time and temperature may be necessary with increasing size and weight of the repeat group. It is preferred that the ratio for the aforementioned blocking agents is between about 0.1 to 1.5, and most preferably between 0.7 to 1.1.

A minor portion of the isocyanate-functionalities of the polymeric starting compound are either blocked, masked or joined to groups or moieties that can be removed by heating. By "a minor portion", it is meant that amount to produce the desired degree of partial crosslinking where more blocked material can be used when the temperature of unblocking is limited so as not to unblock more than the amount needed for partial crosslinking. The uniformity of the partial crosslinking of the polyurethane should be such that no significant amount of gel is formed in the polymer and hence in the film subsequently manufactured. Lightly crosslinked polyurethane has a density ranging from about 0.3 to about 1.1 grams per cc. Preferably, the film has a density of from 0.5 to about 0.9 grams per cc.

The self-crosslinking polyurethane which is used herein can be of the type described in Dabi, et al., U.S. Pat. No. 4,335,029, issued Jun. 15, 1982, which is a stable aqueous dispersion of a room temperature curing polyurethane prepared by: a) dispersing in water an isocyanate-terminated polyurethane prepolymer containing units derived from melamine in the polymer chain and pendant water-dispersing carboxylic salt groups; b) chain extending the dispersed prepolymer with an aliphatic polyamine chain extender more reactive with isocyanate than water; c) end capping the resulting dispersed polyurethane with an organic dihydrazide; and d) reacting the resulting dispersed end capped polyurethane by mixing formaldehyde into the dispersion to convert hydraszide end caps into N-methylol groups. The resulting N-methylol terminated polyurethane contains about 1% to about 5% by weight of units derived from melamine, and about 0.5% to about 10% by weight of carboxylic acid groups, hydroxyl group (which may be supplied by hydroxyethyl acrylate or methacrylate) and the N-methylol group (which may be supplied by N-methylol acrylamide or N-methylol methacrylamide or an ether thereof with a volatile alcohol, such as propanol).

The resulting N-methylol terminated polyurethane contains sufficient neutralized carboxyl groups to enable water dispersion, desirably about 0.5% to about 10% by weight of carboxylic acid groups, about 40% to about 100% of which are neutralized to form salt groups with a volatile amine preferably a tertiary hydroxyethyl.

The in-situ crosslinkable polyurethanes are prepared from the aforementioned isocyanate and polyol monomers and other possible monomers to prepare the coating composition. In this instance, the coating composition is used in conjunction with the sizing composition of the sized fibers, like sized glass fibers, that provides a crosslinking material for the polyurethane. Once the coating composition is applied to the bundle of sized glass fibers and air dried or dried at an elevated temperature, the component of the sizing that acts as crosslinking material can produce in-situ crosslinking of the polyurethane. Suitable size ingredients for producing the in-situ crosslinking of the polyurethane are mono and polyamino functional organo alkoxy silanes and their hydrolyzed derivatives, epoxy organo functional alkoxy silanes and their hydrolyzed derivatives, and polyol-containing materials such as polyoxyalkylenes and the like used as film formers or lubricants in the sizing composition. Suitable examples of the poly(oxyalkylenes) include those recited in my prior U.S. Pat. No. 4,390,647, hereby incorporated by reference. Suitable examples epoxy-containing silanes include: gamma glycidoxypropyltrimethoxysilane available under the trade designation of A-187, beta-(3,4-epoxycyclohexyl) ethyltrimethoxysilane available as A-186, and gamma aminopropyltriethoxysilane available as A-1100 and N-beta-(aminoethyl) gamma-aminopropylmethoxysilane available as A-187, all of which are available from Union Carbide Corporation. Also, these organo functionalities in titanate coupling agents and Werner complex coupling agents can be used. These coupling agents are discussed in U.S. Pat. No. 3,869,308, hereby incorporated by reference. Here, the degree of crosslinking is controlled by the amount of the crosslinking material in the sizing composition which is an amount to cause in-situ crosslinking of the polyurethane covering the size. This effective amount can surpass the amount needed for coupling of the coupling agent in the size to other size components.

The coating composition can have additional ingredients to the carrier and polyurethane which can include debonding agents, plasticizers and thickeners and the like. The debonding agents are preferably waxes that can be used when the modulus of elongation for the polyurethane film is less than around 300 psi at 100 percent elongation. Suitable examples of waxes, plasticizers and thickeners that are useful are disclosed in U.S. Pat. Nos. 4,762,750 and 4,762,751 (Girgis, et al.), hereby incorporated by reference.

The preferred internally crosslinkable polyurethane is the Witco Bond W-290H material that is available from Witco Corporation. This material has a percent solids of 65, is an anionic emulsion with a particle size in micrometers of 2. Also, material has a viscosity of 25° C. (77° F.) Brookfield LVF, centipoise of 400 and a pH of 25° C. (77° F.) of 7.5 and a surface tension, in dynes per centimeter of 42.0. Additionally, the material has a specific gravity at 25° C. (77° F.) of 1.07, a weight per gallon of 8.9. The film properties of the material includes a tensile strength of 4,500 psi and an ultimate elongation of 720 percent, a modulus at 100 percent of 260 psi at 300 percent 540 psi and at 500 percent, 1550 psi. Another suitable material is the Witco Bond 293 polyurethane which should be used in conjunction with a wax debonding agent.

Another suitable polyurethane material is the Baybond XW 110 available from Mobay Chemical Corporation, Pittsburgh, Pa. This material has the following properties: an off-white anionic dispersion of an aliphatic polyester urethane polymer in water/N methyl-2-pyrrolidone, with a solids content of 35 weight percent and a cosolvent content of 15 percent by weight, density in pounds/gallon at 25° C. of 8.7, a specific gravity at 25° C. of 1.04, a viscosity in centipoise at 25° C. of 130, and pH of 8.3, and film properties of tensile strength of 6600 psi, elongation at break of 170 percent, and modulus at 100 percent of 5200 psi.

The coating composition is essentially free of the zinc-containing fatty acids like zinc stearate since the coating composition does not require metal-containing fatty acid materials. In an alternative embodiment, the aqueous coating composition has the independent crosslinkable polyurethane which is the Witco Bond 293H along with an amount of wax in a range of about 1 to about 10 weight percent, an amount of plasticizer in the range of about 1 to about 20 weight percent, an amount of thickener in the range of about 0.5 to about 5 weight percent.

Microcrystalline wax dispersions are well known and are aqueous dispersions containing wax dispersed in water by means of a surfactant, which is preferably anionic, to provide a dispersion of fine particle size. Paraffin waxes having a melting point in the range of 50° C. to 70° C., preferably 55° C. to 65° C., can be used as well as higher melting point waxes and carnauba wax. Also the wax can be blended with polyethylene wax. A suitable thickener can be an acrylic emulsion copolymer. The plasticizer can be present in the aqueous coating composition or in the emulsion or dispersion of the polyurethane as in the Witco Bond 293 material.

The amount of the polyurethane present in the aqueous coating composition can range generally in the amounts disclosed in my prior patents, U.S. Pat. Nos. 4,762,750 and 4,762,751. Additionally, the sizing composition and the application of the size and the application of the coating to the sized glass fibers and the types of fibers can be in accordance with my prior U.S. Pat. Nos. 4,762,750 and 4,762,751 both already incorporated herein. The coated bundle with the carrier-containing coating with the independently partially crosslinkable polyurethane can be crosslinked at ambient conditions with the appropriate type of polyurethane. It is preferred to cure the partially crosslinked polyurethane at elevated temperatures in a continuous manner through an oven. The preferred continuous process and oven are those disclosed in U.S. Pat. No. 5,197,202, entitled, "Method and Apparatus for Drying and Curing a Coated Strand", and U.S. Pat. No. 5,052,125, entitled "Method and Apparatus for Supporting Strand", both of which are hereby incorporated by reference.

The film properties of the independently partially crosslinked polyurethane can be a film modulus equivalent to that of up to around 8000 psi at 100 percent elongation, and an ultimate elongation in the range of around 50 to 1400 percent which is at least a two fold increase in the flexibility of the coated bundle of fibers. Preferably, the increase in flexibility ranges from around a 4 fold to a 50 fold increase over the flexibility of an uncoated bundle of fibers of the same bundle construction and with the same fiber diameters. So these independently crosslinkable polyurethanes provide a partial or slight degree of crosslinking so that the coating of the bundles of fibers or strands do not loose the thermoplasticity of the film or coating.

The present invention will be illustrated by the following nonexclusive examples.

Table I presents four aqueous coating compositions containing independently crosslinkable polyurethanes. The polyurethanes in the table are generally of the internally crosslinkable type. These coating compositions can be applied to bundles of fibers preferably glass fibers to produce the coated bundle by running the bundle through a bath of the aqueous based coating composition and through a die to reduce any excess coating. The treated bundle can travel through an oven at around 500° F. at around 120 to 180 feet/second.

TABLE I

| Formulations | 1 | 2 | 3 | 4 |
|---|---|---|---|---|
| Total volume in Gallons | 3.6 | 0.7 | 0.7 | 0.4 |
| Polyurethane | | | | |
| Witco 290H | 7592 gm | — | — | — |
| Witco 240 | — | 2412 gm | 2412 gm | |
| Witco 160 | — | — | — | 1206 gm |
| Water | 6182 gm | 100 | — | 400 gm |
| Other | — | 100 | — | — |
| Sanitizer | | | | |
| Tween 21 | — | 10 | — | — |
| Teflon Dispersion | — | — | 125 | — |

Example 1 is the preferred embodiment of the present invention where the polyurethane is the sole film forming polymeric material and preferably the only component of the aqueous coating composition. This coating composition was applied to a bundle of glass fibers where the fibers had a diameter of 13.34 plus or minus 0.63 microns and were sized with a sizing composition of U.S. Pat. No. 4,762,751. The construction of the bundle was a group of around 1,000 fibers. The coating was cured at elevated temperatures by the aforementioned continuous process through the oven. The cured bundle was tested for flex life on the MIT tester and for breaking strength. The MIT cycles were 4102 and the breaking strength was 63.4 lbs., and this compares to an uncoated bundle of the same construction having 100 MIT cycles and 36 lb. breaking strength. The MIT flex life test is well known in the art and is described in the American Society of Testing Methods's (ASTM) description D2176 and was performed with a 0.5 pound load. Additionally two other samples of bundles with partially crosslinked coatings were produced that differed from that of Example 1 only in the polyurethane that was used. One used Baybond XW-110 and the other used Witcobond 293 polyurethanes. The MIT cycles for these were: 800, and 5,000 to 6,000, respectively. These results highlight the increase in flexibility of the coated bundle over the uncoated bundle.

Examples 5 and 6

In addition to the four examples of Table I, a fifth and sixth example involved diluting the 290H and the Baybond XW 110 polyurethane to around 30 percent solids viscosity that had a 5 to 7 centipoise viscosity to wet out most of the fibers in the bundle. The aqueous coating composition had an amount of the solids of the 290H material of around 25 to 35 percent. This coating composition was applied to the sized glass fibers where the sizing was that of U.S. Pat. No. 4,762,751 and the bundle had the construction as that for Example 1, K-15. The dip pick up (DPU) of the aqueous coating compositions had the following weight percent LOI: 10 for Example 5 and 15.3 for Example 6. The coated bundle was cured for partial crosslinking in an oven as for Example 1. These bundles with the partially crosslinked coating were subjected to a boiling toluene extraction for 2 hours. An amount of extract in weight percent based on the weight of the yarn was obtained for both Examples 5 and 6 as follows: 2.8 and 1.3, respectively. The weight percent toluene extract based on LOI of the coating was: 48.9 and 8.5 for Examples 5 and 6, respectively. This indicated that the polyurethane had a degree of crosslinking to keep it on the bundle of glass fibers and not removed by the boiling toluene.

In addition, a film of the 290H polyurethane material was prepared and dried at 50° C. for one hour. The film was subjected to a boiling toluene extraction where it was placed in a beaker with the boiling toluene. A residue was separated from the toluene and weighed. The amount of the residue or toluene extract from Just a film of the 290H material was 15.6 weight percent of the film indicating that the 290H film had some crosslinking to prevent it from extraction by the boiling toluene.

Figure 2:
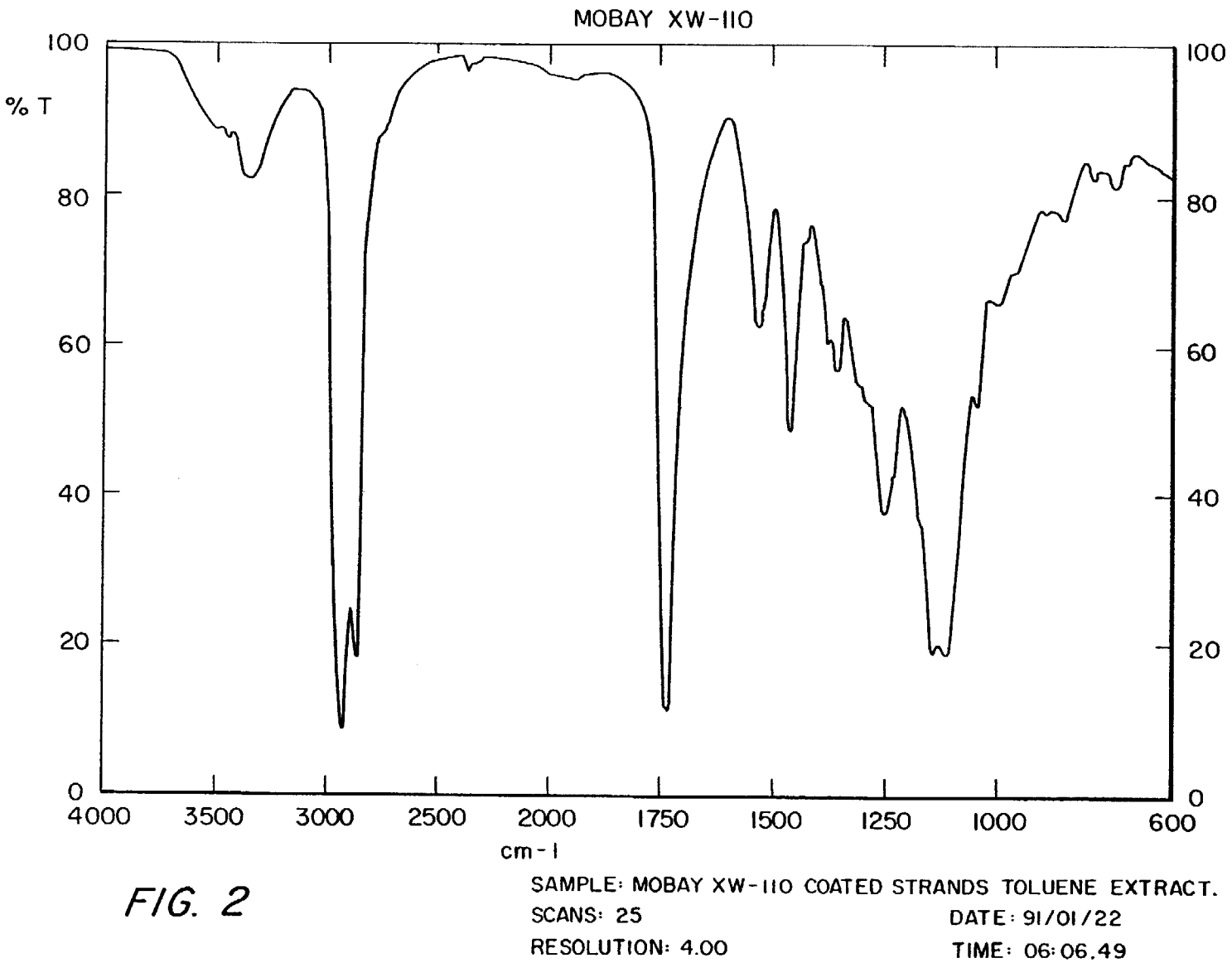
FIG. 2 is an FTIR of the residue obtained from extracting the coated bundle with boiling toluene for two hours where the bundles were coated with Mobay Baybond XW-110 polyurethane.

FIGS. 1 and 2 show the FTIR spectrographs for the extracts from the boiling toluene extractions from the 290H and XW-110 polyurethanes, respectively. The toluene was separated from the extracts to produce films that were analyzed in a Perkin-Elmer 1750 FTIR.

We claim:

1. Flexible bundle of high modulus low elongation fibers, having a modulus of elongation of at least $7\times10^6$ psi and an elongation at break of less than 5 percent, comprising:

a) plurality of fibers constituting the bundle of fibers having a moisture reduced residue of an aqueous chemical sizing composition comprising at least a fiber protectorant on a substantial portion of the surfaces of the fibers in the bundle; and b) carrier reduced residue that is a thermoplastic elastomeric film coating that encapsulates and impregnates the bundle so that a substantial portion of the surfaces of a majority of the fibers of the bundle have a film of the residue, wherein said residue is from a composition having a carrier selected from the group consisting of: organic solvent and water, comprising:

i) at least one carrier soluble, emulsifiable, emulsified, dispersible or dispersed elastomeric thermoplastic polyurethane polymer that is independently partially crosslinkable without the presence of external crosslinking agents in the coating composition which provides a partially crosslinked coating that results in coated bundles of fibers having at least a two-fold increase in flexibility over uncoated bundles of similar construction, ii) the carrier in an amount to give a total solids in the range of around 5 to around 50 weight percent solids, and wherein the impregnating composition is essentially free of an external crosslinking agent.

2. Flexible bundle of claim 1, wherein the at least one independently partially crosslinkable polyurethane is selected from the group consisting of: partially self-crosslinkable, partially internal crosslinkable, partially in-situ crosslinkable polyurethanes and mixtures thereof.

3. Flexible bundle of claim 1, wherein the at least one self-crosslinkable polyurethane is selected from the group consisting of: 1) polyurethane polymers with difunctional repeating units present from polymerization of the polyurethane with tri, tetra, and penta functional monomer and mixture thereof; 2) polyurethanes with a high concentration of urea in the backbone produced from condensation of the polyurethane with diamine compounds; 3) polyurethanes with pendent moieties selected from the group consisting of: amine, carboxylic acid groups, epoxy groups, and ureas; 4) polyurethanes with ethylenic unsaturation in the backbone from the presence of monoethylenically unsaturated polyfunctional monomers including unsaturated polyesters and polyethers in the polymerization of the polyurethane; and 5) polyurethanes selected from the group consisting of: blocked, capped, and masked polyurethanes.

4. Flexible bundle of claim 1, wherein the internal crosslinkable polyurethane is a thermally rearrangeable polyurethanes selected from the group consisting of: polyurethanes with pendent amine groups which can react through a condensation or an addition reaction which upon heating undergo rearrangement crosslinking equivalent to or as provided by the formation of biuret and allophanate groups.

5. Flexible bundle of claim 1, wherein the independently crosslinkable polyurethane is one that can give a degree of crosslinking such that the partially crosslinked polyurethane coating has a film modulus equivalent to up to around 8000 psi at 100 percent elongation, and an ultimate elongation in the range of around 50 to 1400 percent.

6. Flexible bundle of claim 1, wherein internally partially crosslinkable polyurethane is an anionic oil-in-water polyurethane emulsion having a percent solids of 65, a particle size of around 2 micrometers, a viscosity at 25° C. (77° F.) Brookfield LVF of around 400 centipoise, a pH at 25° C. (77° F.) of 7.5 and a surface tension, in dynes per centimeter of around 42 a specific gravity at 25° C. (77° F.) of around 1.07, a weight per gallon of around 8.9 and film properties of tensile strength of 4,500 psi and an ultimate elongation of 720 percent, a modulus at 100 percent of 260 psi and at 300 percent of 540 psi and at 500 percent of 1550 psi.

7. Flexible bundle of claim 6, wherein the extract produced from boiling in toluene for two hours gave an FTIR curve as shown in FIG. 1.

8. Flexible bundle of claim 1, wherein the extract produced from boiling in toluene for two hours gave an IR curve as shown in FIG. 2.

9. Flexible bundle of claim 1, wherein the in-situ partially crosslinked polyurethane results from the presence of a partially crosslinkable polyurethane and an effective partial crosslinking amount of a crosslinking material in the sizing composition present on a substantial portion of at least the fibers in contact with the coating wherein the crosslinking material is selected from the group consisting of: mono and polyaminoorganofunctional trialkoxy silane and hydrolyzed derivatives thereof, epoxyorganofunctional trialkoxy silane and hydrolyzed derivatives thereof, and polyol-containing materials including polyoxyalkylenes.

10. Flexible bundle of claim 1, wherein the polyurethane is present in the carrier-containing composition as a dispersion selected from the group consisting of: an oil-in-water dispersion, oil-in-water emulsion, water-in-oil dispersion, and water-in-oil emulsion.

11. Flexible bundle of claim 10, which includes a plasticizer selected from the group consisting of an internal plasticizer in the polyurethane polymer and external plasticizer present in the dispersion.

12. Flexible bundle of claim 11, wherein when the presence of the plasticizer results in the polyurethane having a film modulus less than around 250 psi at 100 percent elongation there is present in the carrier-containing composition a debonding agent in the amount ranging from around 1 to around 10 weight percent of the composition.

13. Flexible bundle of claim 12, wherein the debonding agent is selected from the group consisting of: wax and microcrystalline wax.

14. Flexible bundle of high modulus low elongation fibers, having a modulus of elongation of at least $7\times10^6$ psi and an elongation at break of less than 5 percent, comprising:

a) plurality of fibers constituting the bundle of fibers having a moisture reduced residue of an aqueous chemical sizing composition comprising at least a fiber protectorant on a substantial portion of the surfaces of the fibers in the bundle; and b) moisture-reduced residue that is a thermoplastic elastomeric film coating that encapsulates and impregnates the bundle so taht a substantial portion of the surfaces of a majority of the fibers of the bundle have a film of the residue, wherein said residue is from an aqueous composition, comprising:

i) at least one water soluble, emulsifiable, emulsified, dispersible or dispersed elastomeric thermoplastic polyurethane polymer that is independently partially crosslinkable without the presence of external crosslinking agents in the coating composition selected from the group consisting of: partially self-crosslinkable, partially internally crosslinkable and partially in-situ crosslinkable polyurethanes wherein when the polyurethane is emulsifiable or dispersible the polyurethane is present in the aqueous composition as a dispersion selected from the group consisting of: an oil-in-water dispersion, oil-in-water emulsion, water-in-oil dispersion, and water-in-oil emulsion, which provides a partially crosslinked coating that results in coated bundles of fibers having at least a two-fold increase in flexibility over uncoated bundles of similar construction, and ii) water in an amount to give a total solids in the range of around 5 to around 60 weight percent and wherein the coating composition is essentially free of an external crosslinking agent.

15. Flexible bundle of claim 14, wherein the at least one self-crosslinkable polyurethane is selected from the group consisting of: 1) polyurethane polymers with difunctional repeating units present from polymerization of the polyurethane with tri, tetra, and penta functional monomer and mixtures thereof; 2) polyurethanes with a high concentration of urea in the backbone produced from condensation of the polyurethane with diamine compounds; 3) polyurethanes with pendent moieties selected from the group consisting of: amine, carboxylic acid groups, epoxy groups, and ureas; 4) polyurethanes with ethylenic unsaturation in the backbone from the presence of monoethylenically unsaturated polyfunctional monomers including unsaturated polyesters and polyethers in the polymerization of the polyurethane; and 5) polyurethanes selected from the group consisting of: blocked, capped, and masked polyurethanes; and the internal crosslinkable polyurethane is a thermally rearrangeable polyurethanes selected from the group consisting of: polyurethanes with pendent amine groups which can react through a condensation or an addition reaction which upon heating undergo rearrangement crosslinking equivalent to or as provided by the formation of biuret and allophanate groups; and the in-situ partially crosslinked polyurethane results from the presence of a partially crosslinkable polyurethane amount of a crosslinking material in the sizing composition present on a substantial portion of at least the fibers in contact with the coating wherein the crosslinking material is selected from the group consisting of: mono and polyaminoorganofunctional trialkoxy silane and hydrolyzed derivatives thereof, epoxyorganofunctional trialkoxy silane and hydrolyzed derivatives thereof, and polyol-containing materials including polyoxyalkylenes.

16. Flexible bundle of claim 15, wherein internally partially crosslinkable polyurethane is an anionic oil-in-water polyurethane emulsion having a percent solids of 65, a particle size of around 2 micrometers, a viscosity at 25° C. (77° F.) Brookfield LVF of around 400 centipoise, a pH at 25° C. (77° F.) of 7.5 and a surface tension, in dynes per centimeter of around 42 a specific gravity at 25° C. (77° F.) of around 1.07, a weight per gallon of around 8.9 and film properties of tensile strength of 4,500 psi and an ultimate elongation of 720 percent, a modulus at 100 percent of 260 psi and at 300 percent of 540 psi and at 500 percent of 1550 psi.

17. Flexible bundle of claim 16, wherein the extract produced from boiling in toluene for two hours is selected from the group consisting of: the extract giving an FTIR curve as shown in FIG. 1 and the extract giving an FTIR curve as shown in FIG. 2.

18. Flexible bundle of high modulus low elongation fibers, having a modulus of elongation of at least $7\times10_6$ psi and an elongation at break of less than 5 percent, comprising:

a) plurality of fibers constituting the bundle of fibers having a moisture reduced residue of an aqueous chemical sizing composition comprising at least a fiber protectorant and up to an effective in-situ crosslinkable amount of compounds selected from the group consisting of: mono and polyaminoorganofunctional trialkoxy silane and hydrolyzed derivatives thereof, epoxyorgano-functional trialkoxy silane and hydrolyzed derivatives thereof, and polyol-containing materials including polyoxyalkylenes on a substantial portion of the surfaces of the fibers in the bundle; and b) moisture-reduced residue that is a thermoplastic elastomeric film coating that encapsulates and impregnates the bundle so that a substantial portion of the surfaces of a majority of the fibers of the bundle have a film of the residue, wherein said residue is from a composition with a carrier, comprising:

i) at least one water soluble, emulsifiable, emulsified, dispersible or dispersed elastomeric thermoplastic polyurethane polymer that is in-situ partially crosslinkable without the presence of external crosslinking agents in the coating composition selected from the group consisting of: polyurethanes which provides a partially crosslinked coating that results in coated bundles of fibers having at least a two-fold increase in flexibility over uncoated bundles of similar construction, and ii) water in an amount to give a total solids in the range of around 8 to around 40 weight percent and wherein the coating composition is essentially free of an external crosslinking agent.

19. Flexible bundle of claim 18, wherein the polyurethane is present in the carrier-containing composition as a dispersion selected from the group consisting of: an oil-in-water dispersion, oil-in-water emulsion, water-in-oil dispersion, and water-in-oil emulsion.

20. Flexible bundle of claim 19, which includes a plasticizer selected from the group consisting of an internal plasticizer in the polyurethane polymer and external plasticizer present in the dispersion, which results in the polyurethane having a film modulus less than around 250 psi at 100 percent elongation, and which includes present in the aqueous composition a debonding agent in the amount ranging from around 1 to around 10 weight percent of the composition and selected from the group consisting of: wax and microcrystalline wax.

21. Flexible bundle of high modulus low elongation fibers, having a modulus of elongation of at least $7\times10^6$ psi and an elongation at break of less than 5 percent, comprising:

a) plurality of fibers constituting the bundle of fibers having a moisture reduced residue of an aqueous chemical sizing composition comprising at least a fiber protectorant on a substantial portion of the surfaces of the fibers in the bundle; and b) moisture-reduced residue that is a thermoplastic elastomeric film coating that encapsulates and impregnates the bundle so that a substantial portion of the surfaces of a majority of the fibers of the bundle have a film of the residue, wherein said residue is from an aqueous composition, comprising:

i) at least one water soluble, emulsifiable, emulsified, dispersible or dispersed elastomeric thermoplastic polyurethane polymer that is independently partially crosslinkable without the presence of external crosslinking agents in the coating composition selected from the group consisting of: partially self-crosslinkable, partially internally crosslinkable and partially in-situ crosslinkable polyurethanes wherein when the polyurethane is emulsifiable or dispersible the polyurethane is present in the aqueous composition as a dispersion selected from the group consisting of: an oil-in-water dispersion, oil-in-water emulsion, water-in-oil dispersion, and water-in-oil emulsion which provides a polyurethane film modulus equivalent to that in the range of around 250 to around 5500 psi at 100 percent elongation, ii) debonding agent selected from the group consisting of wax and microcrystalline wax, iii) plasticizer selected from the group consisting of: dibenzoate esters of dipropylene glycol or any of several polyethylene glycols, and iv) water in an amount to give a total solids in the range of around 8 to around 40 weight percent and wherein the coating composition is essentially free of an external crosslinking agent.

22. Flexible bundle of claim 21 wherein the independently partially crosslinked polyurethane is crosslinked to a degree to provide a nonwicking, encapsulated, and impregnated product.

23. Flexible bundle of claim 1, wherein the independently crosslinkable polyurethane is the sole film forming polymer in the carrier-containing composition.

24. Flexible bundle of claim 1, wherein the carrier-containing composition has an amount of carrier to give a solids content for the composition in the range of around 8 to around 40 weight percent.

25. Flexible bundle of claim 1, wherein the amount of the carrier-containing composition coating the bundle is in the range of around 8 to around 30 weight percent of the coated bundle.

26. Flexible bundle of claim 1, wherein the increase in flexibility is in the range from around 2 times to around 50 times.

27. Flexible bundle of claim 1, wherein carrier-containing composition has an aqueous dispersion of polyfluorocarbons.

28. Flexible bundle of claim 1 wherein the fibers are glass fibers.

29. Flexible bundle of claim 3 wherein a minor portion of the isocyanate-functionalities of the polymeric polyurethane have a minor portion of the blocked, masked or joined groups removable by heat to produce lightly crosslinked polyurethane having a density ranging from about 0.3 to about 1.1 gram per cubic centimeter.

30. Flexible bundle of high modulus low elongation fibers, having a modulus of elongation of at least $7\times10^6$ psi and an elongation at break of less than 5 percent, comprising:

a) plurality of fibers constituting the bundle of fibers having a moisture reduced residue of an aqueous chemical sizing composition comprising at least a fiber protectorant on a substantial portion of the surfaces of the fibers in the bundle; and b) carrier reduced residue that is a thermoplastic elastomeric film coating that encapsulates and impregnates the bundle so that a substantial portion of the surfaces of a majority of the fibers of the bundle have a film of the residue, wherein said residue is from a composition with a carrier, comprising:

i) at least one carrier soluble, emulsifiable, emulsified, dispersible or dispersed elastomeric thermoplastic polyurethane polymer that is independently partially crosslinkable without the presence of external crosslinking agents in the coating composition which provides a partially crosslinked coating that results in coated bundles of fibers having at least a two-fold increase in flexibility over uncoated bundles of similar construction, wherein the polyurethane is selected from the group consisting of:

1) polyurethane polymers with difunctional repeating units present from polymerization of the polyurethane with tri, tetra and/or penta functional monomer;

2) polyurethanes with a high concentration of urea in the backbone produced from condensation of the polyurethane with diamine compounds;

3) polyurethanes with pendent moieties selected from the group consisting of: amine, carboxylic acid groups, epoxy groups, and ureas;

4) polyurethanes with ethylenic unsaturation in the backbone from the presence of monoethylenically unsaturated polyfunctional monomers including unsaturated polyesters and polyethers in the polymerization of the polyurethane; and ii) carrier selected from the group consisting of: organic solvent based and water in an amount to give a total solids in the range of around 5 to around 50 weight percent solids, and wherein the impregnating composition is essentially free of an external crosslinking agent.

* * * * *

UNITED STATES PATENT AND TRADEMARK OFFICE

CERTIFICATE OF CORRECTION

PATENT NO. : 5,455,113

DATED : October 3, 1995

INVENTOR(S) : Mikhail M. Girgis, Peter C. Gaa and Balbhadra Das

It is certified that error appears in the above-indentified patent and that said Letters Patent is hereby corrected as shown below:

Claim 14, column 14, line 1, delete the word "taht" and insert --that--.

Claim 18, column 15, line 8, delete "$7x10_6$" and insert --$7x10^6$--.

Signed and Sealed this

Twentieth Day of August, 1996

*Attest:*

Bruce Lehman

BRUCE LEHMAN

*Attesting Officer*

*Commissioner of Patents and Trademarks*